United States Patent [19]

Miller et al.

[11] Patent Number: 5,018,902

[45] Date of Patent: May 28, 1991

[54] COLLAPSIBLE BOLLARDS

[75] Inventors: James M. Miller, Philadelphia, Pa.; James A. Wargo, Cherry Hill, N.J.

[73] Assignee: Trustees of University of Pennsylvania, Philadelphia, Pa.

[21] Appl. No.: 590,504

[22] Filed: Sep. 26, 1990

Related U.S. Application Data

[63] Continuation of Ser. No. 312,872, Feb. 17, 1989, abandoned.

[51] Int. Cl.[5] ..... E01F 13/00

[52] U.S. Cl. ..... 404/6; 49/35; 49/49; 49/131

[58] Field of Search ..... 404/6, 9, 10; 49/33-35, 49, 131, 133

[56] References Cited

U.S. PATENT DOCUMENTS

| | | | |
|---|---|---|---|
| 3,061,960 | 11/1962 | Dull | 49/35 |
| 3,417,508 | 12/1968 | Sprung | 49/35 |
| 3,925,929 | 12/1975 | Montgomery | 404/6 |
| 4,003,161 | 1/1977 | Collins | 49/35 |
| 4,050,190 | 9/1977 | Mazzone | 49/35 |
| 4,062,149 | 12/1977 | Collins | 49/49 |
| 4,155,199 | 5/1979 | Rubertus | 49/49 |
| 4,715,742 | 12/1987 | Dickinson | 404/6 |
| 4,822,206 | 4/1989 | Roussel et al. | 404/6 |

FOREIGN PATENT DOCUMENTS

| | | | |
|---|---|---|---|
| 0095032 | 11/1983 | European Pat. Off. | 49/49 |
| 3322905 | 1/1985 | Fed. Rep. of Germany | 49/49 |
| 3606809 | 9/1987 | Fed. Rep. of Germany | 49/49 |
| 3718335 | 12/1988 | Fed. Rep. of Germany | 49/49 |
| 1401359 | 4/1965 | France | 49/35 |
| 2523167 | 9/1983 | France | 49/49 |

*Primary Examiner*—Ramon S. Britts
*Assistant Examiner*—Roger J. Schoeppel
*Attorney, Agent, or Firm*—Woodcock, Washburn, Kurtz, Mackiewicz & Norris

[57] ABSTRACT

Improved devices for controlling vehicular traffic are disclosed. The present invention permits the installation of collapsible bollards or posts to create a barrier to vehicular traffic. The bollards disclosed use an internal latch bar and a hinged connection allowing them to be collapsed using an ordinary fire hydrant wrench, thereby permitting access by fire and emergency vehicles to the areas protected by the bollards. Moreover, in the preferred embodiment, a novel spring-loaded latch bar, entirely contained within the bollard and protected from the elements, permits the bollards of the present invention to be reset in a locked position without the use of a hydrant wrench or other tools. Other embodiments disclose how the bollard may be re-locked without the use of tools when the bollard is returned to an obstructing position.

12 Claims, 4 Drawing Sheets

COLLAPSIBLE BOLLARDS

This is a continuation of application Ser. No. 312,872, filed Feb. 17, 1989, now abandoned.

FIELD OF THE INVENTION

The present invention relates to apparatus for controlling vehicular traffic, and more particularly, to devices for providing removable obstructions to control such traffic.

BACKGROUND OF THE INVENTION

Numerous sites, such as universities, amusement parks, shopping centers , malls, hospitals, government installations, and industrial facilities have transitways such as roadways, walks or other open areas from which it is desirable to prevent the transit of vehicular traffic. However, it is usually imperative that authorized vehicles and particularly emergency vehicles be allowed ready access to such areas via these transitways. For example, a university may wish to prohibit vehicular traffic through campus, yet must allow fire or other emergency vehicles to enter the central portion of campus in an expedient manner. Ordinarily, barriers such as chains or gates are erected, there are, however, numerous disadvantages to such solutions. Gates and chains impede pedestrian traffic and pose a safety problem to pedestrians as well. Moreover, the locks or other devices which secure these structures may become frozen in the winter or corrode, thus being rendered inoperable in an emergency. Additionally, if a lock is used, keys must be provided to fire and police personnel; invariably locks are changed without providing new sets of keys, resulting in a possibly life-threatening delay. Similarly, portable wooden barricades are an ineffective solution, since two persons are required in order to erect and move them. Portable wooden barricades suffer from a disadvantage in that they may be moved by any persons, thereby lacking any security.

As an alternative to gates and chains, rows of fixed, spaced posts or bollards may be installed. Fixed bollards limit access by vehicles and allow pedestrians free access, however, their permanence creates an unacceptable barrier to emergency vehicles and an inconvenience to maintenance or other authorized vehicles. In some cases, certain bollards are designed to be removable, however, these designs invariably expose a locking or sliding portion to the elements, leading to the corroded or frozen condition mentioned above. For example, depressible bollards of the type described in U.S. Pat. Nos. 4,576,508 and 4,715,742, both issued to Dickinson, may freeze in either the upright or depressed position, despite whatever efforts are undertaken to weatherize such structures. A major drawback with the retractable bollards of Dickinson and most others, however, is the inherent complexity and cost associated with these types of device.

Thus, there exists a long-felt, yet unfulfilled need for bollards which may be expediently and reliably collapsed in an emergency, yet secure a transitway from unauthorized traffic.

OBJECTS OF THE INVENTION

It is therefore an object of the present invention to provide bollards which may be easily collapsed by emergency or authorized personnel, yet which may be locked securely in an obstructing position to control vehicular access to a transitway.

It is a further object of the present invention to provide bollards having self-contained locking mechanisms which are sturdy, reliable and protected from the elements.

It is also an object of certain embodiments of the present invention to provide collapsible bollards having apparatus for re-locking the collapsed bollard in an obstructing position without the use of tools.

SUMMARY OF THE INVENTION

It has now been discovered that these and other objects of the present invention are accomplished by apparatus comprised of a substantially hollow post which is attached by a hinge to the transitway, allowing the post to be rotated between an obstructing and a collapsed position. A latch for locking the post in an obstructing position is disposed substantially within the post. A mating latch portion for cooperating with the latch disposed in the post is also provided which locks the post in an obstructing position. Latch actuation means are provided which operate to release the latch from the mating latch portion when the post means is in an obstructing position; the post may then be placed in the collapsed position.

The collapsible bollards of the present invention are rendered self-locking or capable of being re-locked in certain embodiments by several alternate methods. A self-locking collapsible barrier made in accordance with certain embodiments of the present invention comprises a post for creating an obstruction, a hinged base attaching the post to a surface and a latch bar for locking said post in an obstructing position. In accordance with certain novel aspects of the present invention the latch is releasable to allow said post to be collapsed, and the latch can automatically re-lock when said post is returned to said obstructing position. In certain of the embodiments disclosed the latch will relock fully when a retaining means is released, however, in the embodiments disclosed, no tools or other apparatus are required to effectuate a locked condition.

In order to facilitate re-locking the bollard, the relocking embodiments of the improved bollards of the present invention disclosed utilize a spring or similar means to return the latch bar to a position substantially aligned with the centerline of the bollard housing.

In a preferred embodiment, a hinge is disposed within the latch bar and a spring mechanism is provided to urge the hinged latch bar back to its original position. After the bollard has been collapsed, the hinge allows a portion of the latch bar to be deflected and engage the base plate when the bollard is returned to the upright position. The spring mechanism continuously urges the latch bar into engagement and eventually into the final locked position. The self-locking mechanism of the preferred embodiment allows the bollard to be erected by the application of a single erecting force and without the use of tools; the bollard is automatically locked in place upon being returned to its upright position.

In another embodiment, a re-locking mechanism used in certain embodiments of the bollards of the present invention is comprised of a spring and ring pin. In this embodiment, the edge of the latch bar engages the flat side of a pin upon the latch bar being rotated to a disengaged position. Thus, upon sufficient latch bar rotation, the spring causes the ring pin to protrude into the interior of the bollard so as to contact the edge of the latch bar, locking it in the disengaged position. In order to re-lock the bollard, the bollard is placed in an upright position and ring pin is pulled to release the latch bar, which then returns to the locked position.

The re-locking mechanism used in certain embodiments of the present invention may alternately comprise a pawl and rachet wheel. In this embodiment, the latch actuation means, such as a hydrant bolt, may only rotate in one direction due to the engagement of the pawl and rachet wheel. Upon sufficient rotation of the latch actuation means, the latch bar will be disengaged and locked in this position be the pawl and rachet wheel. Upon erecting the bollard, the pawl is disengaged, releasing the latch bar and allowing it to return to the locked position.

DETAILED DESCRIPTION

Figure 2:
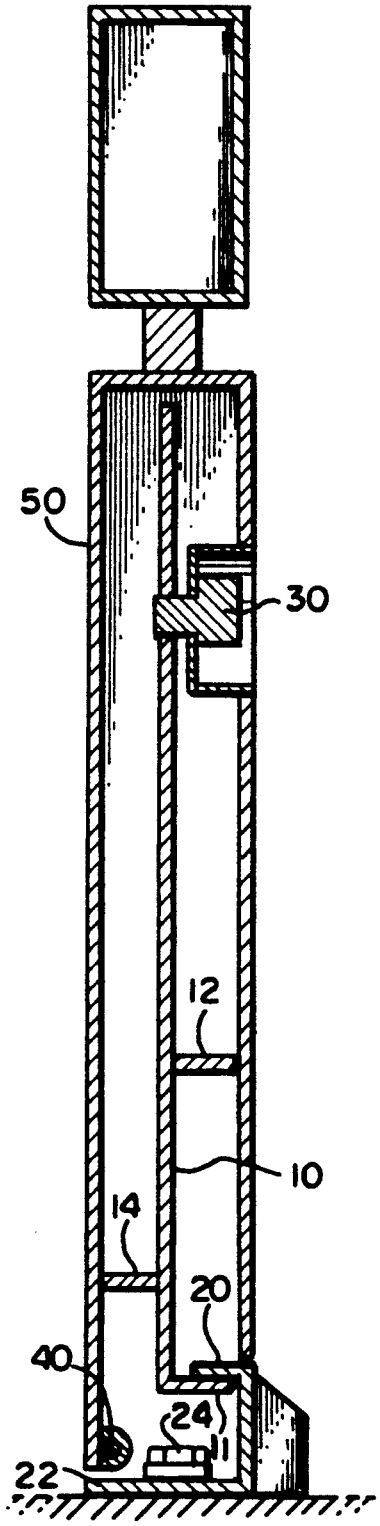
FIG. 2 is a sectional side elevation view, taken along line 2—2 of the bollard depicted in FIG. 1.
Figure 1:
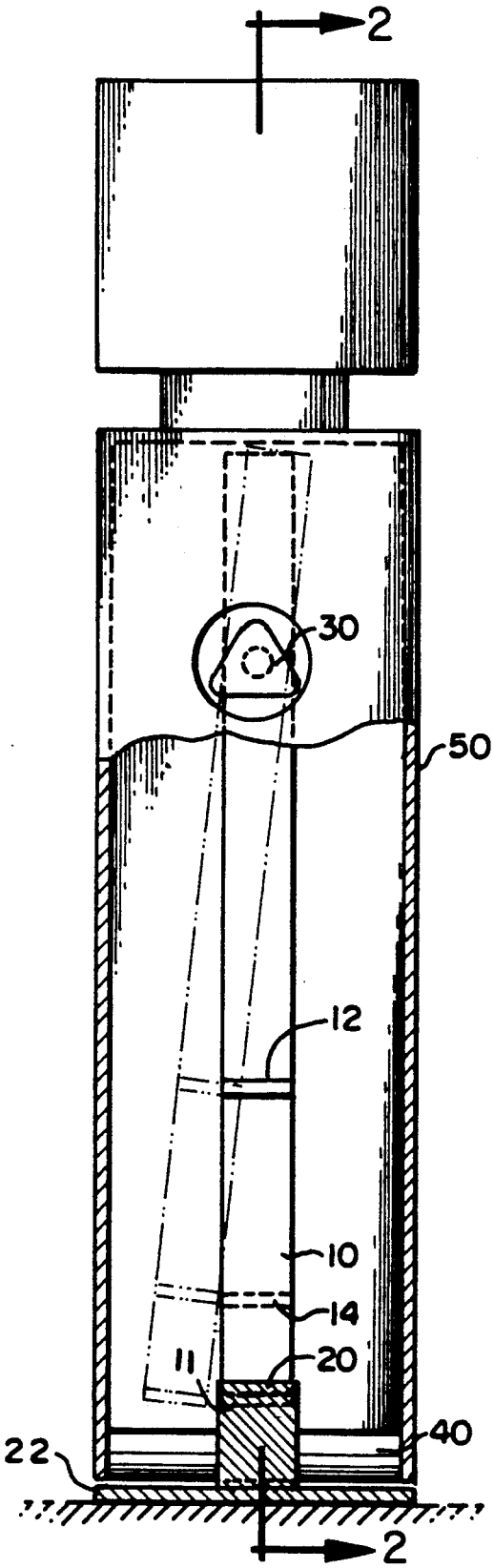
FIG. 1 is a front elevation view, partially cut away, of a collapsible bollard having an internal latch bar.

The need for a semi-permanent bollard, easily collapsible to allow access by emergency and authorized vehicles, is fulfilled by a hinged bollard having an internal latch bar. As illustrated by FIG. 1 and FIG. 2, the internal latch bar 10 is engaged in a cooperating portion 20 of a base plate 22. The base plate 22 is affixed to the roadway or other surface by a bolt 24 or other method. The latch actuation point 30 is designed to be operated with an ordinary hydrant wrench, carried by all emergency vehicles and easily supplied to other authorized vehicles. As seen in phantom in FIG. 1, the latch bar 10 will rotate upon application of torque to the actuation point 30, thereby causing the latch bar 10 to disengage from the cooperating portion 20 of the base plate 22. Guide bars 12,14 are provided to position the latch bar 10 correctly within the bollard and to give additional strength and rigidity to the design. The guide bar 12,14 also prevent the bollard from being disengaged by a sharp blow, which might otherwise cause the latch bar 10 to deflect sufficiently to disengage. After the latch bar 10 has been disengaged, the bollard may be collapsed by means of a hinge 40 provided near the base. As seen in FIGS. 1 and 2, the bollard casing 50 is of a relatively narrow cross section, thereby providing a low profile obstruction in the collapsed position, preferably, this distance is much less than the ground clearance of most vehicles, and presents little possibility of damage should a vehicle drive directly over the collapsed bollard.

In operation, the design illustrated by FIG. 1 and FIG. 2, however, utilizes a hydrant wrench to lock the bollard in an erect, obstructing position after it has been uprighted from its collapsed position. Thus, if a bollard is collapsed, it cannot be returned to an obstructing position and locked in place without the use of a hydrant wrench.

Figure 4:
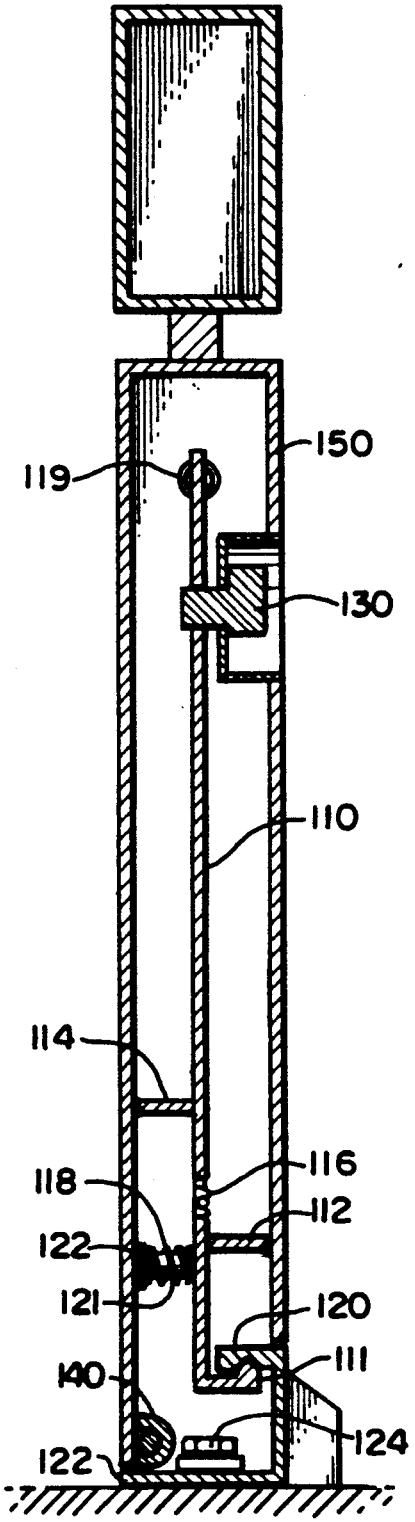
FIG. 4 is a sectional side elevation view, taken along line 4—4 of the improved bollard depicted in FIG. 3.
Figure 3:
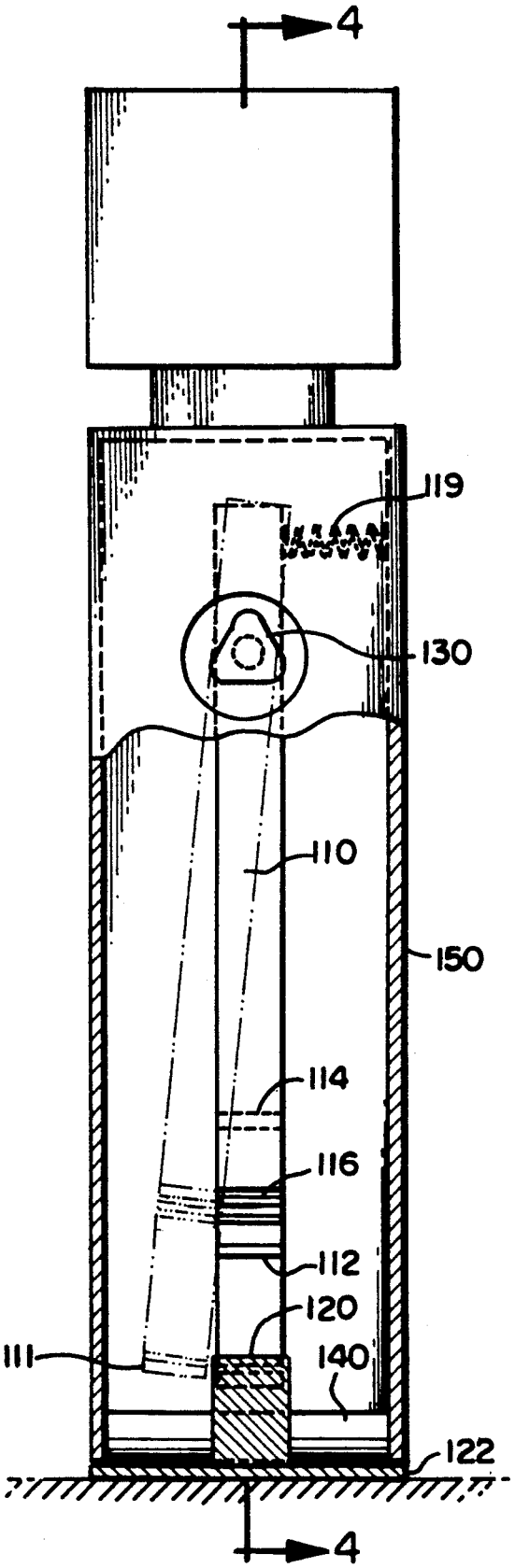
FIG. 3 illustrates in a front elevation view, partially cut away, a preferred embodiment of the self-locking collapsible bollards of the present invention.

Referring now to FIG. 3 and FIG. 4 there is illustrated a preferred embodiment of a self-locking collapsible bollard made in accordance with the present invention. A bollard housing 150 is attached by a hinge 140 to a base plate 122. As seen in FIG. 4, a latch bar 110 is disposed within the housing 150. The locking end of the latch bar 111 cooperates with a locking portion 120 of the base plate 122 to retain the bollard in an upright position. The latch bar 110 is attached to the housing 150 and pivots about a latch actuation point 130. Most preferably, the latch actuation point 130 is comprised of a fire hydrant bolt, although other configurations are equally useful. A fire hydrant bolt is preferred since it provides the requisite security due to the inability to turn the bolt without a specialized hydrant wrench, yet still providing access to fire, emergency, and police vehicles which normally carry such wrenches. The latch actuation point 130 is affixed to the latch bar 110 such as by welding, shrink fitting or other mechanical means so as to form an integral unit. When a torque is applied to the latch actuation point 130, the latch bar 110 will rotate, as shown in phantom in FIG. 3. Upon reaching a point where the latch bar 110 is clear of the locking portion 120 of the base plate 122, the bollard is disengaged and may be collapsed to allow vehicular transit.

Referring again to FIG. 4, the preferred embodiment of the novel self-locking feature of the present invention is visible. Unlike the bollards shown in FIGS. 1 and 2, the latch bar 110 is comprised of two portions connected by a latch bar hinge 116. Also affixed to the latch bar 110 are a lower return apparatus 118 and an upper return spring 119. Two guide bars 112,114 are also attached to the latch bar 110. The guide bars 112 and 114 provide a similar function to those described above with reference to FIG. 1 and FIG. 2, that is, the guide bars 112,114 are provided to position the guide bar 110 correctly within the bollard and to provided additional strength and rigidity to the design. In addition, the guide bars 112,114 prevent the bollard from being disengaged by a sharp blow, which might otherwise cause the latch bar 110 to deflect sufficiently to disengage. In the preferred embodiment, the placement of the guide bars 112,114 also provides appropriate pivot points which allow the latch bar to self-lock.

The novel self-locking feature of the embodiment depicted in FIG. 3 and FIG. 4 is preferred since this embodiment does not require any additional tools or any force other than an erecting force be applied to the bollard. Thus, a person erecting a collapsed bollard made in accordance with the preferred embodiment need only grasp the bollard and rotate it to an upright locked position. This embodiment is an improvement to the bollards illustrated by FIG. 1 and FIG. 2, since numerous bollards may be collapsed in an emergency or for other reasons, and those vehicles carrying hydrant wrenches may depart without re-locking the bollards. Subsequently, maintenance or security personnel may discover the collapsed bollards while on foot or otherwise without a hydrant wrench in their possession and be able to secure the area by re-locking the bollards without the need for a hydrant wrench or other tools.

In operation, after the bollard has been disengaged and collapsed, the upper return spring 119 causes the latch bar 110 to return its original position, aligned with the centerline of the housing 150. As the bollard is erected, the locking end 111 of the latch bar 110 comes into contact with the locking portion 120 of the base plate 122. The latch bar hinge 116 allows the lower portion of the latch bar 110, including the locking end 111, to rotate. However, the resistive urging force provided by the lower return apparatus 118 causes the locking end 111 to remain in contact with the locking portion 120. The lower return apparatus 118 is shown as comprised of a spring 121 and a sliding guide 122 As known to those of ordinary skill, the apparatus depicted represents one of many ways in which a combination of urging force and sliding relative motion may be provided to accomplish the function of urging the locking end 111 into contact with the locking portion 120. As the bollard is brought to a nearly upright position, the locking end 111 will be forced into cooperation with the locking portion 120 and finally aligned in the locked position as depicted in FIG. 4.

Figure 5:
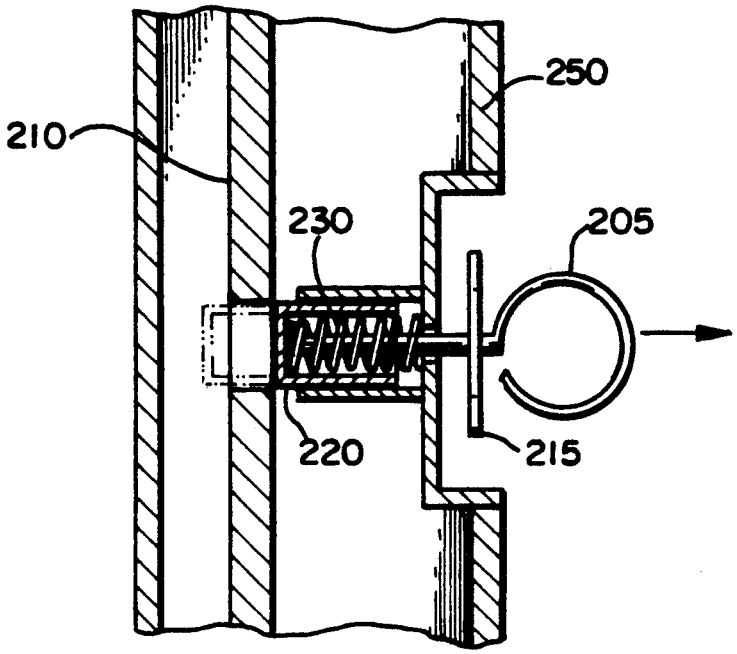
FIG. 5 is a partial sectional side view of a portion of a bollard made in accordance with the present invention, depicting an embodiment of a re-locking mechanism.

An alternate apparatus for providing a self-locking bollard is depicted in FIG. 5. A bollard which utilizes the apparatus of FIG. 5 will be constructed substantially in accordance with FIG. 1 and FIG. 2, however, the upper return spring 119 shown in FIG. 3 and FIG. 4 is also used in substantially the same configuration shown in those Figures. The apparatus depicted in FIG. 5 is preferably located on the bollard housing 250 near the location of the latch actuation mechanism 30 (in FIG. 1), although the apparatus will operate in the same manner regardless of its exact placement.

The apparatus of FIG. 5 is comprised of a ring pin 205 a, ring stop 215, and a retainer cup 220. Disposed between the retainer 220 and the bollard casing 250 is a coil spring 230. As seen in FIG. 5, the distal end of the ring pin is contained within and affixed to the retainer cup 220 and is of sufficient length to retain the latch bar 210 from return to the normal or home position. Thus, when the application of torque via a hydrant wrench or the like to the latch bar 210 causes it to be displaced to the disengaged position, as depicted in phantom in FIG. 1, the urging force provided by the coil spring 230 will cause the distal end of the ring pin 205, to force the retainer cup 220, which had been in contact with a surface of the latch bar 210, to "snap" through, beyond an edge of the latch bar and lock the latch bar 210 in the disengaged position. The ring pin stop 215 will provide a limit to the depth of the penetration of the retainer cup 220. The bollard may then be collapsed, as previously explained.

When it is desired to erect a bollard having a re-locking mechanism constructed in accordance with FIG. 5, the bollard is raised and held by an outside force to a fully upright position. While held firmly in this position, the ring pin 205 is withdrawn, causing its distal end and the attached retainer cup 220 to be withdrawn to a position above the surface of the latch bar 210. Since the latch bar 210 is no longer locked in the disengaged position, the force provided by the upper return spring 219 causes the latch bar 210 to return its original position, aligned with the centerline of the housing 250, as shown in solid lines in FIG. 1.

Figure 6:
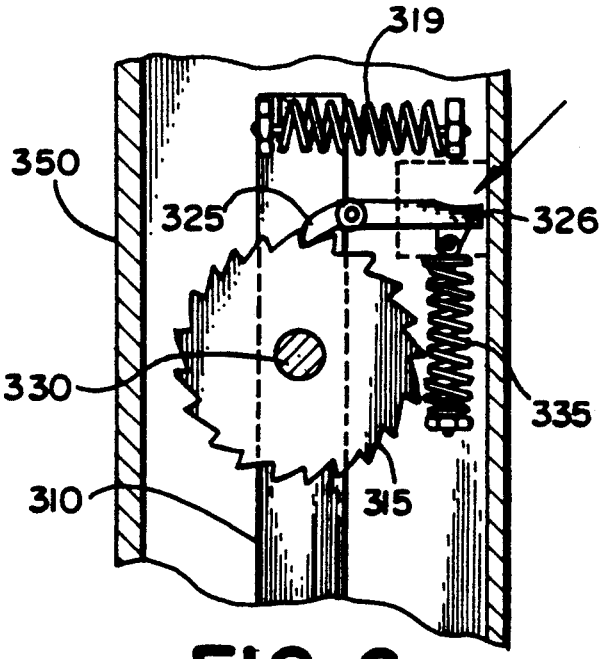
FIG. 6 is a partial sectional frontal view of a portion of a bollard made in accordance with the present invention, depicting another embodiment of a re-locking mechanism.

Another apparatus for providing a re-locking bollard is depicted in FIG. 6. A bollard which utilizes the apparatus of FIG. 6 will be constructed substantially in accordance with FIG. 1 and FIG. 2, however, the upper return spring 119 shown in FIG. 3 and FIG. 4 is also used in substantially the same configuration shown in those Figures.

A self-locking bollard constructed in accordance with FIG. 6 will be provided with a rachet wheel 315, which is co-axial with the latch actuation mechanism 330. Engaging the rachet wheel 315 is the distal end of a pawl 325, which is urged into contact with the rachet wheel 315 by a coil spring 335. The proximal end of the paWl 326 is located Within a recess in the bollard housing 350. Also shown in FIG. 6 are the latch bar 310 and return spring 319, which may be constructed in accordance with elements 110 and 119 depicted in FIG. 3 and FIG. 4.

A bollard constructed in accordance with FIG. 6 is collapsed by applying a torque to the latch actuation mechanism 330, however, the rachet wheel 315 and pawl 325 permit the latch actuation means to be rotated in only one direction. When the latch bar 310 has reached the disengaged position, the locking action of the mechanism depicted causes it to remain there. In order to erect a bollard constructed in accordance with FIG. 6, the bollard is first raised to an upright position. While the bollard is held in the upright position, the proximal end of the pawl 325 is depressed, releasing the locking engagement with the rachet wheel 315. The loss of this resistance allows the force provided by the return spring 319 to cause the latch bar 310 to return its original position, aligned with the centerline of the housing 350, as shown in solid lines in FIG. 1.

Figure 7:
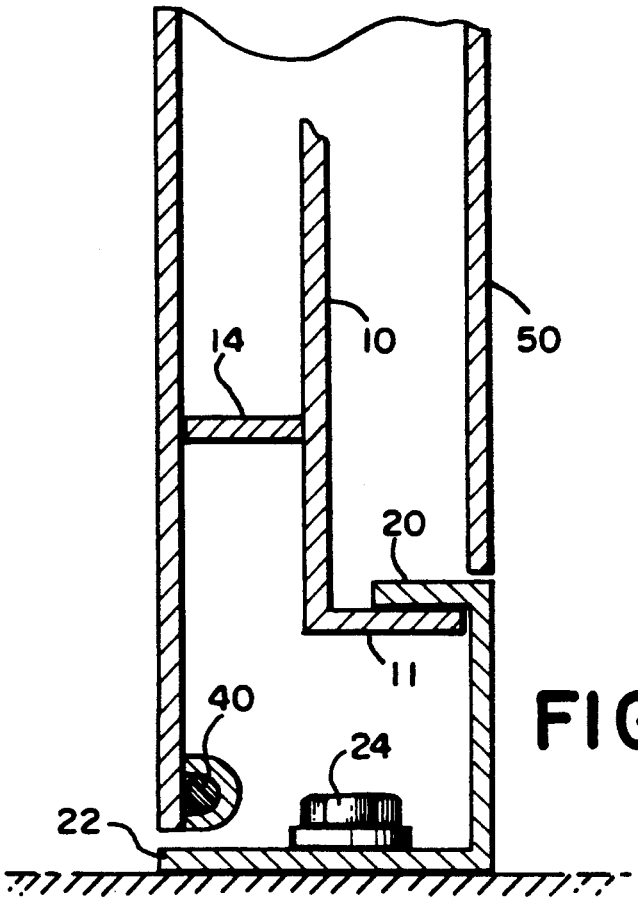
FIG. 7 is a generalized partial side view of a cross section of the bollards of the present invention.
Figure 8:
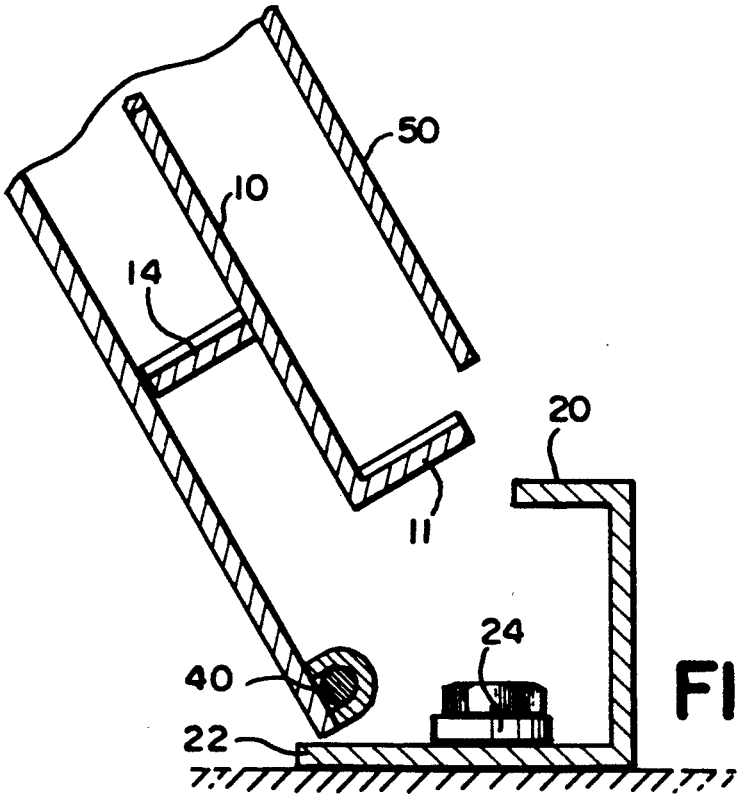
FIG. 8 is a modification of the view shown in FIG. 7 illustrating the manner in which the bollards of the present invention may be collapsed.

Referring now to FIGS. 7 and 8, there is shown a generalized depiction of the operation of the bollards of the present invention. Although the reference numerals indicated correspond generally to those of FIG. 2, the discussion of these features is equally applicable to many other embodiments of the present invention.

FIG. 7 shows the bollard in the upright or locked position. The latch bar 10 and the base plate 20 cooperate to lock the bollard in place. Upon turning the latch bar 10 through a sufficient arc, the locking portion 11 and the cooperating portion 20 disengage, allowing the bollard to pivot about the hinge 22.

Although the bollard is shown attached to the transitway surface by a bolt 24, one of ordinary skill will realize that many variations of attachment methods are available. One of ordinary skill will also realize that it is important that the hinge 40 and base plate 22 be arranged to allow the bollard casing 50 to lie flat on the ground. In some instances, it will be necessary to provide additional portions of the base plate 22 which extend into the ground, both to firmly anchor the bollard and to provide a platform for the hinge to have sufficient room in which to rotate.

Although some embodiments of the present invention have been described with particularity, one of ordinary skill in the art will understand that there are numerous alternate embodiments of apparatus which may be employed to practice the invention. It will also be realized that certain users may have occasion to install the bollards of the present invention in a manner other that illustrated. For example, the base may be attached to a wall, rather that to the ground. Thus, any reference to "horizontal" and "vertical" must be adjusted accordingly, as will be easily understood by those of ordinary skill. Similarly, "transitway" is not limited to the surface of a road or the like, but is meant to include walls, overhangs, ceilings or other structures upon which a collapsible bollard may be mounted to create an obstruction.

Accordingly, the present invention is not limited to those embodiments described. An appreciation of the scope of the present invention may be had by reference to one or more of the appended claims.

What is claimed is:

1. Apparatus for creating a collapsible barrier in a transitway, comprising:

(a) substantially hollow post means;

(b) post hinge means for hingable attaching said post means to the transitway between an obstructing position and a collapsed position, the axis of said post hinge means disposed substantially at the surface of the transitway;

(c) latch means for locking said post in an obstructing position, said latch means disposed entirely within said post means;

(d) mating latch means for cooperating with said latch means to lock said post in an obstructing position and;

(e) latch actuation means for releasing said latch means from said mating latch means when said post means is in an obstructing position to permit said post to be placed in a collapsed position and;

(f) re-locking means for locking said post in an obstructing position when said post is moved to said obstructing position, said re-locking means comprising a latch hinge means connected to said latch means, a resilient means located below said latch hinge means for urging said latch means against said mating latch means, and a return means for aligning said latch means and said mating latch means, whereby said latch means and said mating latch means automatically cooperate when said post is moved to the obstructing position, providing a self-locking barrier.

2. The apparatus of claim 1, wherein said re-locking means is comprised of:

(a) a pin;

(b) a spring;

(c) means for retaining said spring, whereby said spring urges said pin beyond a portion of said latch bar when said latch bar is sufficiently released from said mating latch means.

3. The apparatus of claim 1, wherein said re-locking means is comprised of:

(a) a rachet wheel;

(b) a pawl;

(c) means for urging said pawl into engagement with said rachet wheel; and (d) means for releasing said pawl from engagement with said rachet wheel, whereby said rachet wheel can rotate in only one direction, locking said latch bar in a disengaged position until said means for releasing said pawl is activated.

4. The apparatus of claim 1, wherein said latch actuation means is comprised of a fire hydrant bolt.

5. Apparatus for creating a collapsible barrier, comprising:

(a) post means for creating an obstruction;

(b) base means for hingably attaching said post to a surface, said base means further having means for receiving a latch;

(c) latch means for locking said post in an upright position, said latch means disposed entirely within said post means, and further comprising re-locking means for locking said post in an obstructing position when said post is moved to said obstructing position said re-locking means operating without the aid of any tool or key device, whereby said re-locking means comprises a latch hinge means connected to said latch means and a resilient means located below said latch hinge means for urging said latch means against said mating latch means (d) latch actuation means for disengaging said latch; and (e) return means for engaging said latch means and said means for receiving a latch when said post is in an upright position, whereby upon engagement with the latch receiving means, the latch means bends about the said latch hinge means; and upon disengagement of the latch means with the latch receiving means, said latch means rotates about the base parallel to the axis of rotation of the post means, thereby allowing the post to move into a collapsed position and substantially removing the obstruction created by the post.

6. The apparatus of claim 5, wherein said re-locking means is comprised of:

(a) a pin;

(b) a spring;

(c) means for retaining said spring, whereby said spring urges said pin beyond a portion of said latch bar when said latch bar sufficiently is released from said mating latch means.

7. The apparatus of claim 5, wherein said re-locking means is comprised of:

(a) a rachet wheel;

(b) a pawl;

(c) means for urging said pawl into engagement with said rachet wheel; and (d) means for releasing said pawl from engagement with said rachet wheel, whereby said rachet wheel can rotate in only one direction, locking said latch bar in a disengaged position until said means for releasing said pawl is activated.

8. The apparatus of claim 5, wherein said latch actuation means is comprised of a fire hydrant bolt.

9. Apparatus for creating a collapsible barrier, comprising:

(a) a post;

(b) a base, having means for receiving a latch;

(c) a post hinge connecting said post and said base;

(d) a latch bar disposed entirely within said post, said latch bar having means for re-locking said post in an obstructing position by cooperating with said means for receiving a latch without the aid of any tool or key device, said re-locking means comprising a latch hinge means connected to said latch bar, a resilient means located below said latch hinge means for urging said latch bar against said latch receiving means, and a return means for imparting upon said latch bar a force utilized to re-engage and aligning said latch bar and said latch receiving means; and (e) latch actuation means for disengaging said latch bar from said means for receiving a latch; and whereby said post is disengaged from said base by said latch actuation means, thereby allowing said post to be rotated about said post hinge and placed in a horizontal position.

10. The apparatus of claim 9, wherein said re-locking means is comprised of:

(a) a pin;

(b) a spring;

(c) means for retaining said spring, whereby said spring urges said pin beyond a portion of said latch bar when said latch bar sufficiently is released from said mating latch means.

11. The apparatus of claim 9, wherein said re-locking means is comprised of:

(a) a rachet wheel;

(b) a pawl;

(c) means for urging said pawl into engagement with said rachet wheel; and (d) means for releasing said pawl from engagement with said rachet wheel, whereby said rachet wheel can rotate in only one direction, locking said latch bar in a disengaged position until said means for releasing said pawl is activated.

12. The apparatus of claim 9, wherein said latch actuation means is comprised of a fire hydrant bolt.

* * * * *